US008695890B2

(12) United States Patent
Butler et al.

(10) Patent No.: US 8,695,890 B2
(45) Date of Patent: Apr. 15, 2014

(54) SPRAYING DEVICE AND METHOD OF USING SAME

(75) Inventors: Martin Butler, Hull (GB); Steve Walsh, Hull (GB)

(73) Assignee: Reckitt & Colman (Overseas) Limited, Slough, Berkshire (GB)

( * ) Notice: Subject to any disclaimer, the term of this patent is extended or adjusted under 35 U.S.C. 154(b) by 736 days.

(21) Appl. No.: 12/513,444

(22) PCT Filed: Sep. 22, 2008

(86) PCT No.: PCT/GB2008/003212

§ 371 (c)(1),
(2), (4) Date: Dec. 22, 2009

(87) PCT Pub. No.: WO2009/037491

PCT Pub. Date: Mar. 26, 2009

(65) Prior Publication Data

US 2013/0001315 A1 Jan. 3, 2013

(30) Foreign Application Priority Data

Sep. 21, 2007 (GB) ..... 0718458.3
Apr. 16, 2008 (EP) ..... 08007448

(51) Int. Cl.
*A01G 25/09* (2006.01)
*B05B 17/00* (2006.01)

(52) U.S. Cl.
USPC ..... 239/1; 239/68; 239/69; 239/73; 239/337; 222/183; 222/645; 222/649

(58) Field of Classification Search
USPC ..... 239/67–70, 73, 337–339, 1; 222/183, 222/638, 639, 644, 645, 649
See application file for complete search history.

(56) References Cited

U.S. PATENT DOCUMENTS

| | | | | |
|---|---|---|---|---|
| 3,586,243 | A | 6/1971 | Jones | |
| 5,676,283 | A * | 10/1997 | Wang | 222/649 |
| 5,938,076 | A * | 8/1999 | Ganzeboom | 222/23 |
| 6,401,990 | B1 | 6/2002 | Walters et al. | |
| 2002/0130146 | A1 | 9/2002 | Borut | |

FOREIGN PATENT DOCUMENTS

| | | | |
|---|---|---|---|
| EP | 0038598 | A1 | 10/1981 |
| FR | 2667508 | A1 | 10/1990 |
| FR | 2667508 | A1 | 4/1992 |
| FR | 2667509 | | 12/1993 |
| GB | 2443729 | A | 5/2008 |
| WO | 2005009325 | A | 2/2005 |
| WO | 2005113420 | A | 12/2005 |

* cited by examiner

*Primary Examiner* — Christopher Kim
(74) *Attorney, Agent, or Firm* — Norris McLaughlin & Marcus PA

(57) ABSTRACT

A spraying device (10) is described, the device comprising a housing (12) adapted to receive a refill (16) of fluid therein and having an aperture (14) suitable for permitting, in use, the spraying of a fluid therethrough, the device further comprising actuation means (24) configured for periodic actuation of the refill, wherein the device is provided with detection means (26) configured to distinguish between at least one area of lower reflectance and at least one area of relatively higher reflectance on a spray head of said refill. Methods of operation of such a spraying device are also described.

14 Claims, 5 Drawing Sheets

SPRAYING DEVICE AND METHOD OF USING SAME

This is an application filed under 35 USC 371 of PCT/GB2008/003212.

FIELD OF THE INVENTION

The present invention relates to a device for spraying a fluid and particularly, but not exclusively to a device for spraying fluids such as fragrances, deodorizing fluids and/or a pest control materials or the like. The present invention also relates to a method of using such a device.

BACKGROUND

Prior art devices for spraying fragrances, deodorizing agents and sanitising fluids into a room generally consist of a device containing a removable source of fluid. With such an arrangement once the source of fluid has been completely exhausted, the source can be replaced rather than replacing the entire device. Typically such sources come in many forms, including containers, bottles, cans and cartridges (generically, all such containers, bottles, cans and cartridges hereinafter will be referred to as "refills"). Such refills can be pump sprays or aerosols, including metered and non-metered versions thereof.

Known prior art devices typically comprise a housing having an opening through which the fluid is sprayed. A part of the housing is movable/removable to permit a refill to be introduced and subsequently removed from the interior of the device. The device further comprises a mechanically actuated arm or the like therein which is adapted to periodically activate in order to press down on a spray head connected to the refill, resulting in fluid passing from the body of the refill, through the spray head and out of the opening in the housing into the surrounding environment.

The shape of a refill is typically standardised to a certain degree, as such, spraying devices may unwittingly provide an opportunity to facilitate vandalism or dangerous behaviour. Specifically, vandals or the like may seek to intentionally insert a dangerous source of sprayable fluid into a spraying device. For instance, where the device is for spraying a fragrance and the refill is an aerosol of a standard size, one form of vandalism and/or intentional abuse could be the insertion of a paint aerosol into the device. The resulting damage from such abuse could be substantial. Such abuse would likely be associated with a significant health and safety risk. Clearly it would be desirable from a user's perspective to be protected from such dangerous behaviour and/or acts of vandalism.

It is one object of the present invention to address the above mentioned concerns and disadvantages.

SUMMARY OF INVENTION

According to a first aspect of the present invention there is provided therefore a spraying device with a refill of fluid therein, wherein the refill comprises a body forming a reservoir for the fluid and a spray head located at the uppermost part of the refill in fluid communication with the reservoir, and wherein the device comprises a housing adapted to receive the refill therein and having an aperture suitable for permitting, in use, the spraying of the fluid from an exit orifice of the spray head therethrough, the device further comprising actuation means configured for periodic actuation of the refill, wherein the device is provided with detection means configured to distinguish between at least one area of lower reflectance and at least one area of relatively higher reflectance on the spray head of said refill.

Reflectance relates to radiation striking a surface, some of it is absorbed and some is reflected. Reflectance is expressed as a unitless proportion. For the avoidance of doubt, the term "lower reflectance" is used herein as a relative term with reference to the term "higher reflectance"; "lower" may include areas of zero or near zero reflectance.

The body of the refill may be elongate, and the body may be provided with a valve stem at an upper portion of the body remote from the base of the body. At least a portion of the valve stem may be connected to the spray head to permit, in use, fluid to pass from the body of the refill, through the valve stem and through the spray head to the exit orifice where the fluid is sprayed into the surrounding environment.

Preferably the spray head is provided with one area of lower reflectance and one area of relatively higher reflectance.

Preferably the detection means are configured to operate to distinguish between areas of differing reflectance during movement of the spray head.

Advantageously the device according to the present invention may be able to detect when a user attempts to use the device with a potentially dangerous refill and, further, the device is preferably configured to deny the actuation means from activating and/or deny subsequent activation whilst such a refill is loaded in the device to prevent and/or limit any damage that could result from actuating the refill.

A further advantage of the devices of the present invention is that they may be able to provide an improved end of life indication. In use, when a device according to the present invention detects the at least one area of lower reflectance and at least one area of relatively higher reflectance on the spray head of the refill loaded therein, a counting mechanism may be triggered. The counting mechanism may be calibrated to allow a pre-determined number of actuations of the refill which corresponds to the quantity of fluid stored in a refill. The counting mechanism may be operable in use, and after the pre-determined number of actuations has been reached, to prevent the device from causing further actuations of that refill until a user replaces the refill and/or resets the device. The device may automatically reset every time a refill is loaded into the device. This end of life indication may be advantageous as the power consumption of the device will be minimised, this would be particularly advantageous where the device is battery powered or the like.

The counting mechanism may be linked to an indicator that is adapted to communicate to the user of the device that a used or spent refill needs to be replaced.

Preferably the pre-defined number of actuations is calculated to correspond to the quantity of fluid in the refill.

Preferably the detection means are in direct communication with the actuation means such that, in use, the detection means may instruct the actuation means not to activate.

Alternatively a control means may be provided that is in direct communication with both the detection means and the actuation means, said control means being operative to receive an input from the detection means and being operative to instruct the actuation means to activate or not depending on the received input.

The control means may be provided in the form of a micro processor, a circuit provided on a PCB or in the form of another convenient component(s).

Preferably the actuation means are operable to cause actuation of the refill spray head by imparting a substantially downward force on the spray head. Said substantially downward force is preferably sufficient to cause the spray head to move in a substantially downward direction to open the fluid pathway between the body of the refill and the exit orifice of the spray head to spray a quantity of fluid out of the opening in the housing into the surrounding environment. Once a quantity of fluid has been sprayed, the device may be configured such that the refill's inherent resilience and/or internal pressure is capable of applying a substantially upward force on the spray head sufficient to return the actuation means to its starting position without the need for power to be applied to said means.

The detection means of the present invention is adapted, in use, to distinguish between areas of differing reflectance on a spray head of a refill. Preferably the detection means is capable of distinguishing as mentioned by interrogating the refill. The refill spray head may be interrogated by the detection means emitting radiation toward the spray head and collecting reflected radiation such that the amount of reflectance can be attributed specifically or approximately or generally to one or more portions of the spray head. Such attribution may permit the detection means to directly, or in combination with a control unit, to determine whether any areas of differing reflectance are present on the spray head. If there are no areas of differing reflectance on the spray head of the refill there should be a substantially constant level of reflected radiation. Therefore in an alternative arrangement, the interrogation of the refill by the detection means may permit the detection means to detect whether at least one differing level of reflected radiation is detected without attributing the detected level of reflectance to a specific portion of the spray head. Such detection may permit the detection means to directly, or in combination with a control unit, determine whether any areas of differing reflectance are present on the spray head.

The detection means may be configured to make a determination that there are differing levels of reflectance between at least two separate portions of the spray head when the reflectance from one portion is at least 0.5 times greater than from the a separate portion of the spray head, and preferably at least 2 times greater, and more preferably at least 5 times greater, and even more preferably at least 10 times greater, and even more preferably still at least 50 times greater, and most preferably at least 100 times greater.

As mentioned, it is preferable for the detection means to be configured to be operable to distinguish between areas of differing reflectance during the movement of the spray head. Even more preferably the detection means is configured to only be so operable during the movement of the spray head. This may be advantageous since this would permit the detection means to have a fixed location within the device and have no moving parts, thus reducing the cost of the detection means and rendering them less likely to fail during the life of the device. Additionally, with such an arrangement the detection means may have a predefined field of view allowing a refill manufacturer more defined parameters for ensuring the spray head is suitably detectable by the detection means. A further advantage exists where the device is to be battery powered as the detection means will only draw power during the actuation of the refill.

Preferably the detection means may be confined to only be operable to distinguish between areas of differing reflectance during the substantially upward movement of the spray head, i.e. the upward movement of the spray head after the downward movement caused by the actuation means. In this arrangement the inherent resilience and/or internal pressure of the refill may be sufficient to return the actuation means to its starting position without power being applied to said means. Such an arrangement may be particularly advantageous since the substantially upward movement of the spray head may be achieved without power being applied to the activation means, thus reducing or eliminating electrical noise/interference produced by the device. The reduction in electrical noise/interference may improve the ability of the detection means to distinguish areas of differing reflectance on the spray head, thus improving the reliability of the detection means whilst allowing a relatively inexpensive detection means to be used.

The detection means may be operable to determine whether a refill is loaded into the device before being operable to distinguish between areas of differing reflectance. In this arrangement the detection means may be operable to interrogate the location within the device normally occupied by a spray head of a refill when loaded into the device, if the detection means does not detect any reflectance, or a predetermined level of reflectance, this situation may be indicative of the absence of a refill in the device and the detection means will prevent the actuation means from activating. This arrangement may also be advantageous as it will prevent the actuation means from periodically activating after a user has removed a spent refill and before a new refill is loaded into the device.

Preferably the detection means are provided with a fixed location within the device and, preferably, have a fixed field of view with respect to the spray head of a refill or the area normally occupied by the spray head when a refill is loaded in the device.

Alternatively or additionally the detection means may be configured to move in order to interrogate the spray head or the area normally occupied by the spray head. The detection may be movable in a substantially horizontal direction and/or a substantially vertical direction and/or in at least two directions. The detection means may be able to pivot about a single position to perform the scan. The detection means may be provided with a wide-angle lens, such as a fish eye lens, to provide a wide field of view when performing the interrogation of the refill.

The detection means may be provided in the form of one or more sensors. The sensor(s) is preferably provided with an integrated radiation emitter that is adapted to emit radiation and further provided with a collecting portion that is adapted to collect any reflected radiation. Alternatively, the sensor may only comprise the collecting portion, the radiation emitter being a separate component that is positioned so that it is capable of emitting radiation toward the spray head such that at least some of the reflected radiation may be collected by the collecting portion.

Preferably the sensor(s) is an optical sensor in the form of an Infra-Red sensor, more preferably a passive Infra-Red sensor. Alternatively or additionally, the optical sensor(s) may be provided in the form of a light sensor or laser sensor.

The detection means may be configured to interrogate with an effective range of up to 100 mm, the effective range being the distance any interrogation must travel once reflected by the spray head in order to be detected by the detection means, ie, the distance between the detection means or source of the interrogation to the spray head in addition to the distance the reflected interrogation must travel to the detection means to be collected and detected. Preferably the detection means with an effective range of up to 50 mm, and more preferably up to 20 mm, and even more preferably up to 10 mm, and most preferably up to 5 mm.

According to an alternative aspect of the present invention there is provided therefore a spraying device with a refill of fluid therein, wherein the refill comprises a body forming a reservoir for the fluid and a spray head located at the uppermost part of the refill in fluid communication with the reservoir, and wherein the device comprises a housing adapted to receive the refill therein and having an aperture suitable for permitting, in use, the spraying of the fluid from an exit orifice of the spray head therethrough, the device further comprising actuation means configured for periodic actuation of the refill, wherein the device is provided with detection means configured, in use, to interrogate the spray head to distinguish between at least one area of lower reflectance and at least one area of relatively higher reflectance on the spray head of said refill, characterised in that the spray head is provided with at least one portion shaped to substantially reflect the detection means interrogation back toward said means and is provided with at least one portion shaped to substantially deflect the detector means interrogation away from said means.

In the alternative aspect of the present invention the at least one area of lower reflectance is provided by the at least one portion of the spray head that is shaped to deflect the interrogation from the detection means away from the detection means such that a lower amount of the interrogation (be it radiation for example) is detected by said means in comparison to the amount of interrogation detected by the detection means when the interrogation of the at least one portion shaped to reflect said interrogation toward said means, the area of higher reflectance.

According to a further alternative aspect of the present invention there is provided therefore a spraying device with a refill of fluid therein, wherein the refill comprises a body forming a reservoir for the fluid and a spray head located at the uppermost part of the refill in fluid communication with the reservoir, and wherein the device comprises a housing adapted to receive the refill therein and having an aperture suitable for permitting, in use, the spraying of the fluid from an exit orifice of the spray head therethrough, the device further comprising actuation means configured for periodic actuation of the refill, wherein the device is provided with detection means configured, in use, to interrogate the spray head to distinguish between at least one area of lower reflectance and at least one area of relatively higher reflectance on the spray head of said refill, characterised in that the spray head is provided with at least one portion shaped to substantially reflect the detection means interrogation back toward said means and is provided with at least one portion shaped or cutaway to avoid the interrogation of the detector means.

In the further alternative aspect of the present invention the at least one area of lower reflectance is provided by the at least one portion of the spray head that is shaped or cutaway to avoid the interrogation from the detection means such that a lower or zero amount of the interrogation (be it radiation for example) is detected by said means in comparison to the amount of interrogation detected by the detection means when the interrogation of the at least one portion shaped to reflect said interrogation toward said means, the area of higher reflectance.

According to a yet further alternative aspect of the present invention there is provided therefore a spraying device with a refill of fluid therein, wherein the refill comprises a body forming a reservoir for the fluid and a spray head located at the uppermost part of the refill in fluid communication with the reservoir, and wherein the device comprises a housing adapted to receive the refill therein and having an aperture suitable for permitting, in use, the spraying of the fluid from an exit orifice of the spray head therethrough, the device further comprising actuation means configured for periodic actuation of the refill, wherein the device is provided with detection means configured, in use, to interrogate the spray head to distinguish between at least one area of lower reflectance and at least one area of relatively higher reflectance on the spray head of said refill, characterised in that the interrogation emitted from detection means is configured to be detectable over a predefined distance that is substantially equal to the effective range, and wherein the spray head is provided with at least one portion shaped to substantially reflect the detection means interrogation back toward said means and is provided with at least one portion shaped or cutaway relative to the location of the detection means.

As discussed above, the effective range is used herein to relate to the distance any interrogation must travel in order to be detected by the detection means, ie, the distance between the detection means or source of the interrogation to the spray head in addition to the distance the reflected interrogation must travel once reflected by the spray head to the detection means to be collected and detected.

In this further alternative arrangement, by tuning the distance the interrogation is able to travel such that it is capable of travelling the distance between the non-cutaway portion of the spray head and back again after reflection, it is possible to distinguish between one area of lower reflection and one area of higher reflection. Due to the tuning of the interrogation, the amount of interrogation collected by the detection means would be less for the interrogation reflected from the cutaway portion than from the non-cutaway portion of the spray head, this difference in reflectance being detectable by the detection means, thus indicating two areas of differing reflectance. The tuning of the distance or the intensity of the interrogation is capable of travelling could be made greater or smaller than the abovementioned distance, what is important is that the interrogation is tuned such that the cutaway portion of the spray head produces a lesser amount of reflected interrogation compared with the non-cutaway portion which is collectable and detectable by the detection means.

According to a second aspect of the present invention there is provided therefore a spraying device comprising a housing adapted to receive a refill of fluid therein and having an aperture suitable for permitting, in use, the spraying of the fluid from the refill therethrough, the device further comprising actuation means configured for periodic actuation of the refill, wherein the device is provided with detection means configured to distinguish, in use, between at least one area of lower reflectance and at least one area of relatively higher reflectance on a spray head of said refill.

According to an alternative aspect of the present invention there is provided therefore a spraying device adapted to receive a refill of fluid therein and having an aperture suitable for permitting, in use, the spraying of the fluid from the refill therethrough, the device further comprising actuation means configured for periodic actuation of the refill, wherein the device is provided with detection means configured, in use, to interrogate a spray head of the refill, characterised in that the device is configured to interrogate a refill having a spray head wherein at least one portion of the spray head is shaped to substantially reflect the detection means interrogation back toward said means and at least one portion of the spray head is shaped to substantially deflect the detector means interrogation away from said means such that, in use, the device can distinguish between at least one area of lower reflectance and at least one area of relatively higher reflectance on the spray head of said refill.

According to a further alternative aspect of the present invention there is provided therefore a spraying device adapted to receive a refill of fluid therein and having an aperture suitable for permitting, in use, the spraying of the fluid from the refill therethrough, the device further comprising actuation means configured for periodic actuation of the refill, wherein the device is provided with detection means configured, in use, to interrogate a spray head of the refill, characterised in that the device is configured to interrogate a refill having a spray head wherein at least one portion of the spray head is shaped to substantially reflect the detection means interrogation back toward said means and at least one portion of the spray head is shaped or cutaway to avoid interrogation by the detector means such that, in use, the device can distinguish between at least one area of lower reflectance and at least one area of relatively higher reflectance on the spray head of said refill.

According to a yet further alternative aspect of the present invention there is provided therefore a spraying device adapted to receive a refill of fluid therein and having an aperture suitable for permitting, in use, the spraying of the fluid from an exit orifice of the spray head therethrough, the device further comprising actuation means configured for periodic actuation of the refill, wherein the device is provided with detection means configured, in use, to interrogate a spray head on the refill to distinguish between at least one area of lower reflectance and at least one area of relatively higher reflectance on the spray head of said refill, characterised in that the interrogation emitted from detection means is configured to be detectable over a predefined distance that is substantially equal to the effective range, and wherein the spray head for use with the device is provided with at least one portion shaped to substantially reflect the detection means interrogation back toward said means and is provided with at least one portion shaped or cutaway relative to the location of the detection means.

According to a third aspect of the present invention there is provided therefore a method of spraying a fluid from a device, the method comprising the steps of loading a refill of fluid in a spray device according to any of the first or second aspects of the present invention, placing the device in an operation mode, said mode being configured to cause activation of the actuation means, said actuation means periodically operating to bear against a spray head of the refill and causing the movement thereof to release a quantity of fluid from the refill, said released fluid being sprayed from the device through an aperture in the housing into the surrounding environment, characterised in that detection means provided in the device are operable in the operation mode to detect and distinguish between at least one area of lower reflectance and at least one area of relatively higher reflectance on a spray head of said refill or within the area normally occupied by said spray head.

Preferably the detection means are operable during the activation of the actuation means and the movement of the refill spray head. Even more preferably the detection means are only operable during the activation of the actuation means. Most preferably the detection means are configured to only be operable during the substantially upward movement of the refill spray head, i.e. the upward movement of the spray head after the downward movement caused by the actuation means.

The method may comprise a preceding step before activation of the actuation means wherein the detection means performs an initial interrogation of the area within the housing normally occupied by the spray head of a refill when a refill is loaded in the device. In this preceding step if the detection means does not detect any reflectance, or a predetermined level of reflectance, this may be indicative of the absence of a refill in the device and the detection means will prevent the actuation means from activating.

The method of the third aspect of the present invention is preferably operable to prevent the activation of the actuation means if the detection means is unable to detect and distinguish between said at least two areas of differing reflectance. Alternatively the method of the third aspect of the present invention is preferably operable to prevent the further activation of the actuation means if the detection means is unable to detect and distinguish between said at least two areas of differing reflectance. The prevention of activation or further activation may be maintained until a user resets the device and/or initiates a manual override of the ongoing prevention.

Turning to the refill to be used in the aforementioned devices or methods, the areas of differing reflectance on the spray head may be provided by areas of different colours. Preferable colour combinations providing the required difference of reflectance are combinations of a light colour with a dark colour, wherein the light colour provides an area possessing a higher level of reflectance of radiation than the dark colour which provides a an area possessing a greater tendency to absorb radiation thus an area of lower reflectance. A particularly preferable combination is that of a substantially white colour and a substantially black colour. Most preferably the spray head is provided in a substantially white colour with a substantially black colouration (eg. a mark, a dot, a square, a rectangle, a triangle, or the like) being provided on the stem of the spray head. For instance, where the spray head is generally L-shaped, the stem would be the shorter part of the L-shape which is connected to the valve stem of the refill body and said shorter part has a single substantially black mark on a rearward portion thereof.

The areas of differing reflectance on the spray head may be provided by areas of different Infra Red (IR) reflectance. Particularly preferred means of providing areas of differing IR reflectance include the use of inks/paints/lacquers that are absorbers or reflectors of IR radiation and, preferably, are invisible to the naked eye under normal light conditions.

The sensor may be operable to detect wavelengths in the range of 700-1350 nm. Preferably the sensor is operable to detect wavelengths in the range of 800-1100 nm. More preferably the sensor is operable to detect wavelengths in the range of 850-1000 nm. Most preferably the sensor is operable to detect wavelengths in the range of substantially 940 nm.

The areas of differing reflectance may be applied to, or incorporated in, the spray head by any suitable means. Particularly preferred methods include the initial application of the at least one area of differing reflectance to a label which is subsequently attached to the spray head. Alternatively, the at least one area of differing reflectance may be printed, engraved and/or applied directly on to the spray head. As a further alternative, the spray head could be manufactured from two or more component parts, wherein at least two of said parts are provided with external areas thereof having distinguishable reflective properties with respect to each other.

Typically the spray head is opaque, however, in an alternative arrangement the spray head may be substantially transparent and the valve stem of the refill could be provided with the area of differing reflectance. For instance, the valve stem could have a dark colouration, and this may create a detectable difference for the detection means. Alternatively, the spray head may be provided with a substantially transparent window in registration with the valve stem to permit the valve stem to be viewed by the detection means to provide the areas of differing reflectance.

The spray head of a refill typically has a generally L-shaped profile, wherein the shorter part of the L-shape engages with the free end of the valve stem. Preferably the spray head of the refill for use with the device of the present invention is generally L-shaped with an angle of substantially 90° between the part of the spray head connected to the valve stem and the part of the spray head possessing the exit orifice; this angle may be between 60-120° however.

In an alternative arrangement, the spray head could be shaped to deflect any interrogation away from the detection means of the device. In the device of the present invention the detection means may be provided in a fixed position and will, therefore, only have a limited filed of view of the spray head to interrogate and will only have a limited field or area in which it will be able to detect reflected interrogation. Therefore, the spray head may be shaped such that one portion of the spray head viewable by the device's detection means is shaped to substantially reflect the detector means' interrogation (eg. by being generally flat and substantially parallel with the detection means or curved, preferably with a gentle curvature) and at least one portion of the spray head viewable by the device's detection means is shaped to substantially deflect the detector mean' interrogation (eg. by being angled relative to the direction of the interrogation and the location of the detection means such that the reflected interrogation is reflected away from a collection part of the detection means thus being substantially non-detectable or less detectable).

In this alternative arrangement for the spray head having reflecting and deflecting portions it may be preferable for the lower portion of the spray head (the portion of the spray head connected to the valve stem) to be the reflecting portion by having a generally flat and parallel or gently curved outer surface relative to the fixed location of the detection means in the device of the present invention to reflect, in use, interrogation toward the detection means. In this arrangement the deflecting portion would preferably be an upper portion of this spray head having a generally flat or gently curved outer surface angled away from the fixed location of the detection means in the device of the present invention to deflect, in use, interrogation away form the detection means. For instance, the surface may be shaped to deflect the interrogation at 90° away from the normal, and preferably to deflect the interrogation at >90° away from the normal. The deflection portion may have a V-shaped profile aligned with a source of interrogation to deflect the interrogation away in two different directions, neither of those directions being toward the detection means, preferably being at 90° away from the normal, or more preferably at >90° away from the normal. Upper and lower portion of the spray head referred to for this alternative arrangement of the spray head are used interchangeably, indeed, the upper portion may be the reflecting portion and the lower part the deflecting portion and vice versa as described.

In a further alternative arrangement, the spray head could be provided with a cutaway to avoid interrogation, in use, by a detection means. Such a cutaway may be located within the area of the spray head that is interrogated by the detection means such that the detection means' may detect the difference in the reflectance of the interrogation from a portion (eg. a reflecting portion) of the spray head against the absence of any reflectance in the cutaway. The cutaway may be provided by the spray head being shaped to have a non-typical shape (i.e. not an L-shape) in order to provide the same effect as the cutaway. For instance, the spray head may comprise a short substantially vertical section for engaging the free end of the valve stem and have a short substantially horizontal section for directing the spray of fluid through the aperture of the device, and the spray head may have a longer transverse section between said short sections. The result of this unusual configuration of the spray head may result in the same effect as the cutaway, such that the detection means' scan of the spray head detects the difference in the reflectance of the short substantially vertical section of the spray head against the absence of any reflectance above the short substantially vertical section.

In a yet further alternative arrangement, the spray head could be provided with a portion cutaway to provide a greater distance for reflected interrogation to travel, in use, to a detection means in comparison to the distance for reflected interrogation to travel from a non-cutaway portion of the spray head. In this arrangement the interrogation, say by radiation emitted from the detection means, should be tuned such that it is capable of travelling the distance between the non-cutaway portion of the spray head and back again after reflection, however, should that distance be increased the radiation is less capable of travelling the increased distance. Due to the tuning of the radiation, the amount of radiation being collected by the detection means would be less for the radiation reflected from the cutaway portion than from the non-cutaway portion of the spray head, this difference in reflectance being detectable by the detection means, thus indicating two areas of differing reflectance.

The areas of differing reflectance on the spray head may be provided in the form of at least one line of differing reflectance. Said one or more lines preferably being substantially perpendicular relative to an inlet section of the spray head; in other words, in a substantially horizontal direction when the refill is placed on a flat surface. Such orientation of the lines may be advantageous since it could improve the likelihood that the detection means could distinguish between lines having differing reflectance, particularly where said detection means are operable during the movement of the spray head.

The areas of differing reflectance on the spray head may be provided in the form of two lines of differing reflectance. Alternatively, the areas of differing reflectance on the spray head may be provided in the form of a plurality of lines of differing reflectance. The use of two or a plurality of lines may be advantageous as these may be able to operate as a code capable of imparting additional information to the device beyond whether the refill is a safe refill or not.

Alternatively the areas of differing reflectance could be provided in the form of one or more patterns and/or one or more shapes and/or one or more letters and/or one or more numerals.

Such further information could include the particular type of refill to permit the device to alter its mode of operation. For instance, where the refill contains an insecticide, the spraying frequency may desirably be different to when the device is spraying an air freshener or the like.

As another example, the further information may relate to a specific end of life period for that particular refill. In this arrangement the device may be able to adjust the pre-determined number of actuations depending on the amount of fluid stored in the refill and the number of actuations that quantity of fluid will permit, wherein the pre-determined number for that particular type of refill is stored in said further information.

Alternatively, areas of reflectance could impart said further information wherein the detection means is adapted to recognize the presence of a specific reflective property, said specific reflective property may be referenced against an internal memory of such properties in order to permit the device to recognize the further information.

The device of any of the above-mentioned aspects may be provided with an indicator wherein said indicator is operable to indicate information to a user. Such information may include: whether the refill loaded in the device is potentially dangerous as it is not intended for use with the device; whether the refill needs to be changed; whether the battery or batteries need to be changed (where the device is to be battery powered); and other potentially useful information.

The indicator may be operable to provide a visual indication and/or provide an audible indication.

Preferably the indicator is configured to provide a visual indication by emitting light from one or more light sources, preferably one or more LEDs. The one or more light sources may be adapted to emit a different colour of light to indicate the current function the device is performing. Additionally or alternatively, the one or more light sources may blink or flash to indicate the current function the device is performing.

A visual indicator may be provided in the form of an LCD screen or the like wherein the screen is adapted to provide a message to a user, for instance such messages could include "ON", "DANGEROUS REFILL INSERTED", "CHANGE REFILL", "CHANGE BATTERIES", "NUMBER OF SPRAYS REMAINING", "LIFE OF REFILL", "OFF".

The device may be provided with a boost mechanism. The boost mechanism may be linked to a user operated switch or button or the like. On operating the boost mechanism the actuation means may activate to cause the immediate actuation of a refill.

The device may be power by mains-supplied electricity and/or be battery powered and/or be powered by solar cells located on the device. Most preferably the device is battery powered.

According to a fourth aspect of the present invention there is provided therefore a spray head for a refill of fluid for use with a device or method according to any preceding aspect of the present invention wherein the spray head comprises an inlet section and an exit orifice, wherein the inlet section is adapted to connect with a valve stem of a refill and the exit orifice is capable of directing a spray of fluid away from the refill body, characterised in that the spray head has an external surface having at least one area of lower reflectance and at least one area of relatively higher reflectance.

According to a fifth aspect of the present invention there is provided therefore a refill of fluid for use with a device or method according to any preceding aspect of the present invention wherein the refill comprises a body for containing a quantity of fluid and a valve stem with a spray head connected thereto, the spray head comprising an inlet section and an exit orifice defining a fluid pathway from the body to the exit orifice, characterised in that the spray head has an external surface having at least one area of lower reflectance and at least one area of relatively higher reflectance.

According to the sixth aspect of the present invention there is provided therefore a device according to the first or second aspect of the present invention configured to operate in accordance with the method of the second aspect of the present invention.

For the avoidance of doubt, all of the features disclosed in this specification and/or all of the steps of any method or process so disclosed, may be combined in any combination, except combinations where at least some of such features and/or steps are mutually exclusive. Each feature disclosed in this specification may be replaced by alternative features serving the same, equivalent or similar purpose, unless expressly stated otherwise. Thus, unless expressly stated otherwise, each feature disclosed is one example only of a generic series of equivalent or similar features.

BRIEF DESCRIPTION OF THE DRAWINGS

Embodiments of the invention will now be described, by way of example only, with reference to the following drawings in which.

DESCRIPTION OF AN EMBODIMENT

Figure 2:
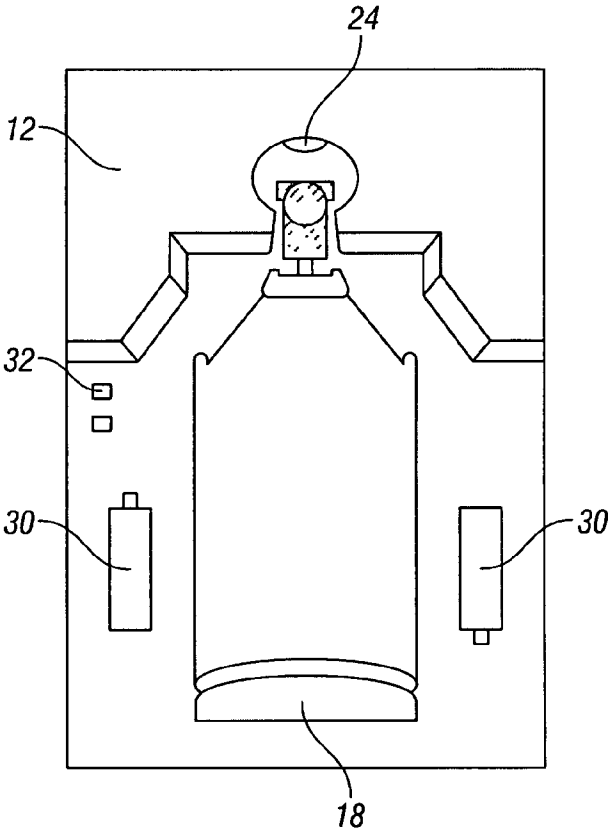
FIG. 2 illustrates a front elevation of a device of the present invention with a refill loaded therein.
Figure 1:
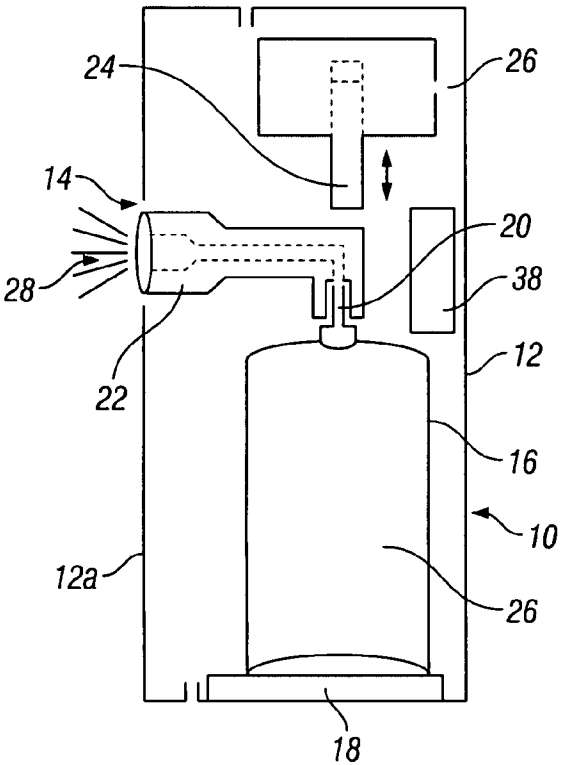
FIG. 1 illustrates a side elevation of a device of the present invention with a refill loaded therein.

As shown in FIGS. 1 and 2 a fragrance spraying device 10 comprises a housing 12 with a removable front section 12*a* through which there is an opening 14. The front section 12*a* may be hinged to permit access to the interior of the device 10. A refill 16, in this example an aerosol spray canister, is held within the housing 12 on a platform 18. An outlet stem 20 of the spray canister 16 is received in a lower opening of a spray head 22. An actuation means 24 is located above the refill 16 and possesses an arm 24 that is moveable to apply substantially downward pressure on the spray head 22 and cause actuation of the refill 16. During actuation of the refill, fluid held within the body 26 of the refill 16 is forced through the valve stem 20, into the spray head, exiting the spray head via an exit orifice in the form of a nozzle 28 into the external environment. The actuation means 26 is powered by batteries 30.

The device is further provided with a detection means 38 located substantially adjacent to the normal location of a spray head when a refill is loaded into the device 10.

Although not shown, the detection means 38 includes a sensor configured to face the spray head 22, the sensor being adapted to emit radiation in this embodiment, preferably IR radiation, toward the spray head 22 to interrogate it. The sensor is also capable of collecting reflected radiation in order to distinguish between different areas of reflectance on the spray head 22 with the sensor's field of view.

The detection means 38 can be in direct communication with the actuation means 26 or, alternatively, in communication with a control unit (not shown) which is in communication with the actuation means 26. The communication between the detection means 38 and the actuation means 26, whether directly or indirectly via the control unit, being essential to permit the device to be capable of producing a response when a dangerous and/or abusive refill is loaded into the device 10.

In use, the refill 16 is placed on the platform 18 and the valve stem 20 is engaged in an inlet 34 of the spray head 22. The refill 16 is a replaceable item and the spray head 22 is typically supplied with the refill 16.

When the refill 16 is placed in position a fluid path for fragrance (or other material, such as sterilising material/insecticide material/bactericide material or the like) for spraying is formed from the refill 16 through the spray head 22 and past the opening 14 in the front section of the housing 12*a* and out into the surrounding environment.

In order to cause spraying of the fluid from the refill 16, the actuation means is activated causing the arm 24 to move down onto the spray head 22 and pushing the spray head in a substantially downward direction. The downward movement of the spray head 22 effects corresponding downward movement of the valve stem 20 which opens the valve and permits fluid to flow through the valve stem, spray head and out of opening 14 into the surrounding environment.

The actuation means 26 has numerous selectable settings which a user may select via a user input means 32. The user input means 32 can be operable to allow a user to select whether the device is turned on or off, the specific operation mode of the device such as its spray frequency, timer delay or other such feature. Preferred frequency settings would be the option of the fluid being sprayed from the refill every nine minutes, or every eighteen minutes, or every thirty-six minutes.

Figure 3A:
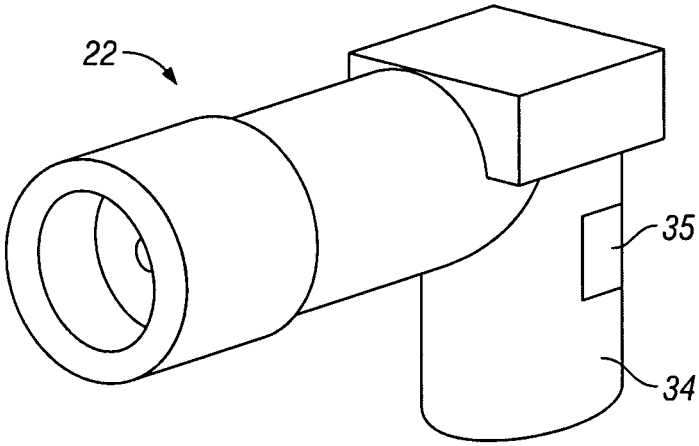
FIG. 3A illustrates a perspective view of a first embodiment of a refill spray head.
Figure 3B:
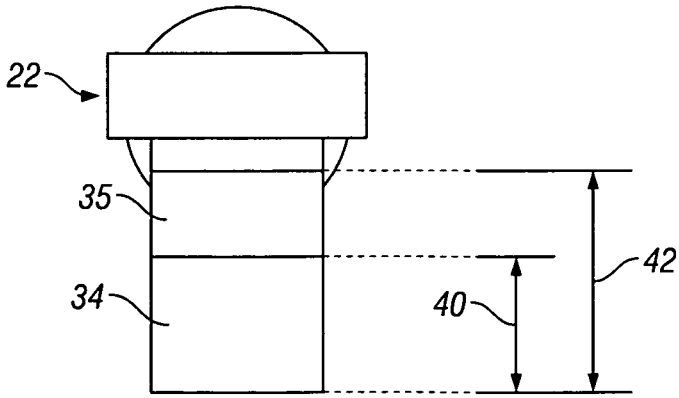
FIG. 3B illustrates a rear elevation of a spray head of FIG. 3A.

Referring to FIG. 3, the areas of differing reflectance on the spray head 22 can be seen. Specifically, a portion of the neck 34 of the spray head 22 is coated with a layer of dark ink/paint/lacquer 35 which is of a lower reflectance than the remainder of the neck 34 which is uncoated.

In one embodiment of the invention, the detection means 38 can be operable to detect the presence of the spray head 22 and, further, detect whether there is at least one area of low reflectance and at least one area of higher reflectance on the spray head 22.

Firstly the detection means 38 may be operable to detect whether a refill 16 is loaded in the device by interrogating the area normally occupied by a spray head 22 when a refill is loaded therein. Prior to permitting the actuation means 24 to activate, the detection means 38 may perform an initial interrogation of the location within the device normally occupied by a spray head of a refill when loaded into the device, if the detection means does not detect any reflectance, or a predetermined level of reflectance, this situation may be indicative of the absence of a refill in the device and the detection means 38 will prevent the actuation means from activating, either directly by communicating therewith or indirectly via a control unit. Preferably the detection means would interrogate an area normally occupied by lower portion of the neck of the spray head, as indicated by arrow 40 on FIG. 3B.

Should the presence of a refill 16 be detected, the detection means is further configured to interrogate further portions of the spray head 22. The detection means 38 may be capable of interrogating the spray head 22 by emitting radiation toward the spray head, such as IR radiation, across one or more portions thereof, such as across a field of view as indicated by arrow 42. The detection means is capable of collecting reflected radiation such that the amount of reflectance collected can be attributed specifically or approximately or generally to a portion or portions of the spray head 22. Such attribution may permit the detection means 38 to directly, or in combination with the control unit (not shown), determine whether any areas of differing reflectance are present on the spray head 22.

Alternatively, the interrogation of the refill by the detection means 38 may permit the detection means to detect whether at least one differing level of reflected radiation is detected without attributing the detected level of reflectance to a specific section of the spray head. Any such detection may permit the detection means 38 to directly, or in combination with the control unit (not shown), determine whether any areas of differing reflectance are present on the spray head or in the area normally occupied thereby.

With either form of interrogation, if differing areas of reflectance are detected the detection means 38 will communicate directly with the actuation means 26, or indirectly via a control unit (not shown), to permit the actuation means 26 to operate in accordance with the user input command to cause the spraying of fluid.

Conversely, if differing areas of reflectance are not detected, i.e. a potentially dangerous refill has been loaded into the device, the direct or indirect communication from the detection means 38 will call for the actuation means 26 to enter a dormant mode. During the dormant mode the actuation means 26 will not activate and not cause the spraying of fluid. The dormant mode will be maintained until a user initiates a resetting of the device. The resetting may be facilitated by the user loading a new refill into the device and/or the user operating a reset button or the like. However, if a vandal has intentionally loaded a potentially dangerous refill and has reset the device, once the detection means 38 scans the spray head 22 and fails to find the required reflectance, the actuation means 26 will again be placed in the dormant mode.

In an alternative embodiment, the detection means can be operable to detect the presence of the spray head 22 and detect whether there is at least one area of low reflectance and at least one area of higher reflectance on the spray head 22 only during the movement of the spray head 22 following activation by the actuation means 26. This movement permits the detection means 38 the opportunity to view a defined proportion of the spray head 22, thus fixing the field of view of the detection means (eg. as defined by arrow 42 in FIG. 3B). If during the interrogation of the spray head 22 differing areas of reflectance are detected by the detection means 38, these means will communicate with the actuation means 26, either directly or indirectly, to permit the actuation means 26 to operate in accordance with the user input command to cause the spraying of fluid. Conversely, if differing areas of reflectance are not detected, i.e. a potentially dangerous refill has been loaded into the device, potentially to effect vandalism, the communication from the detection means 38 will call for the actuation means 26 to enter a dormant mode, as discussed above.

When a refill 16 has been loaded in the device 10 and the detection means 38 has been able to distinguish between one area of lower reflectance and once area of higher reflectance, the control means or the like may initiate a counting mechanism. The counting mechanism may be calibrated to permit a pre-determined number of actuations of the refill which corresponds to the quantity of fluid stored in a refill. The counting mechanism can be operable in use, and after the pre-determined number of actuations has been reached, to cause the device 10 to enter the dormant mode, thus prevent further actuations of that refill, until a user replaces the refill and/or resets the device. The counting mechanism may automatically reset every time a refill is loaded into the device.

FIGS. 3-6 illustrate various embodiments of refill spray heads. As mentioned, FIG. 3 illustrates a first embodiment wherein spray head has a generally L-shaped profile, wherein the shorter part of the L-shape, the neck portion 34, engages with the free end of the valve stem. The angle between the part of the spray head connected to the valve stem and the part of the spray head possessing the exit orifice is illustrated as being substantially 90°, however this angle may be between 60-120°, the key aspect is that the exit orifice directs the spray of fluid through the opening 14 and away from the housing of the device. The neck portion 34 of the spray head 22 is coated with a layer of dark ink/paint/lacquer 35 which is of a lower reflectance than the remainder of the neck 34 which is uncoated. Ideally the layer of dark is substantially black and the rest of the spray head, including the remainder of the neck portion 34, is substantially white.

In FIG. 3 the layer of dark ink/paint/lacquer is coated on to the spray head but this may be applied or incorporated by any suitable means, such as by application of a label, printing, engraving or the spray head could be manufactured from two or more component parts which are fixed together.

Figure 4A:
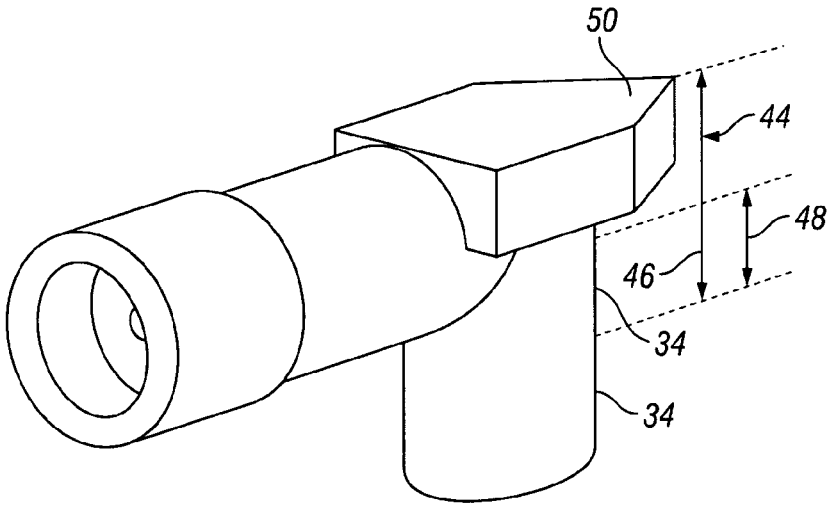
FIG. 4A illustrates a perspective view of a second embodiment of a refill spray head.
Figure 4B:
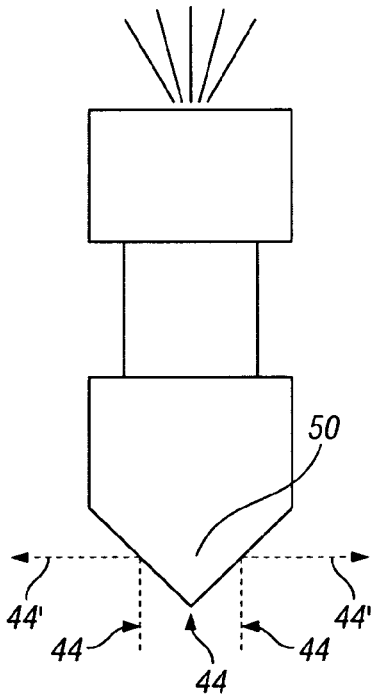
FIG. 4B illustrates a plan view of a spray head of FIG. 4A.
Figure 5A:
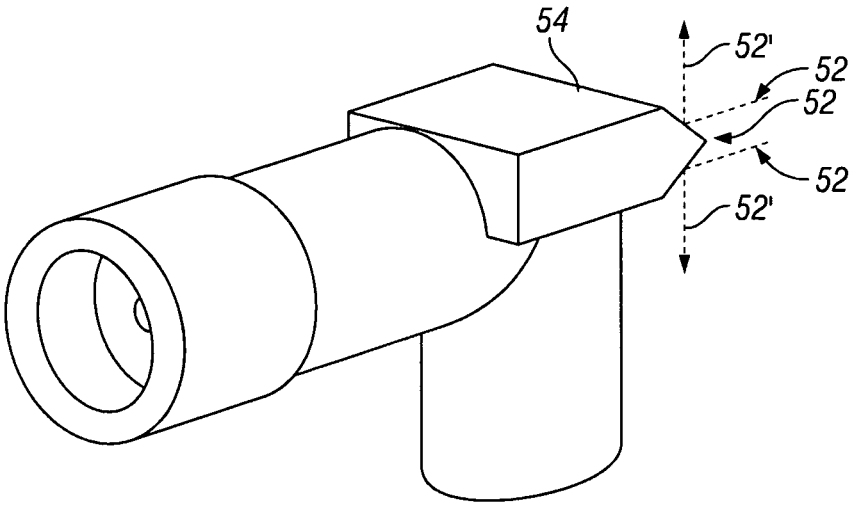
FIG. 5A illustrates a perspective view of a third embodiment of a refill spray head.
Figure 5B:
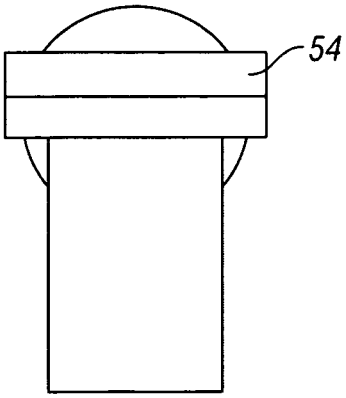
FIG. 5B illustrates a rear elevation of a spray head of FIG. 5A.

In FIGS. 4 & 5 the spray head 22 is shaped to deflect any interrogation away from the detection means 38 of the device. The detection means for use with the spray head shown in FIG. 4 will have a fixed position and a limited filed of view of the spray head to interrogate as indicated by arrow 46. Arrow 48 shows the field of view detection means may detect to determine whether a refill 16 is loaded in the device by interrogating the area normally occupied by a spray head 22 when a refill is loaded therein.

The detection means is operable to emit interrogation in the direction of arrow 44 and a V-shaped portion 50 of the spray head is shaped to substantially deflect the detector means' interrogation not back toward the detection means but away therefrom in the direction of arrows 44'. In contrast the neck portion 4 of the spray head is shaped to substantially reflect the interrogation back toward the detection means to be collected thereby. The deflection of interrogation 44 by the V-shaped portion 50 may be shaped to deflect the interrogation at 90° away from the normal or >90° away from the normal.

The spray head illustrated in FIG. 5 is similar to that as shown in FIG. 4 save for the 90° orientation of the V-shaped potion 54, thus causing, in use, a different direction of deflection of interrogation 52 in the direction of arrows 52'.

Figure 6A:
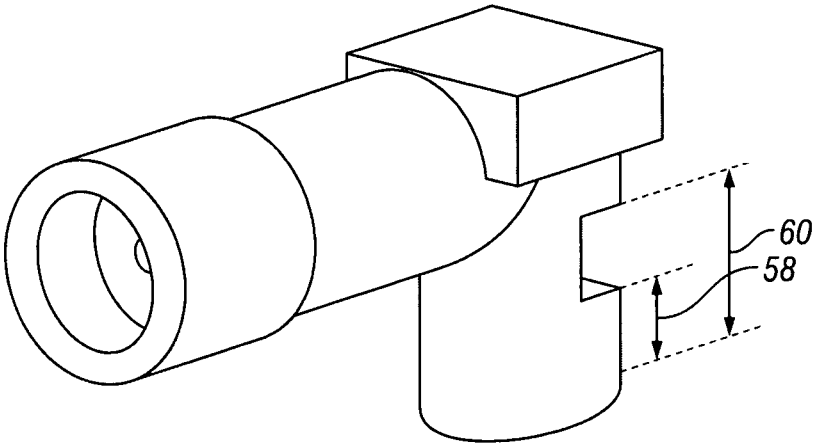
FIG. 6A illustrates a perspective view of a fourth embodiment of a refill spray head.
Figure 6B:
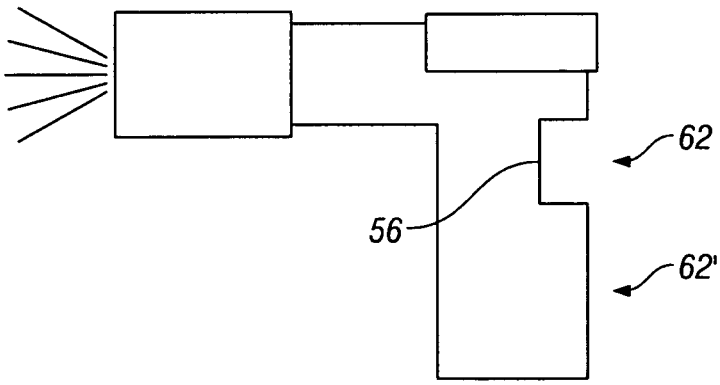
FIG. 6B illustrates a side elevation of a spray head of FIG. 6A.

In FIG. 6 a yet further alternative arrangement of the spray head is illustrated could be provided with a portion cutaway to provide a greater distance for reflected interrogation to travel, in use, to a detection means in comparison to the distance for reflected interrogation to travel from a non-cutaway portion of the spray head. The detection means for use with the spray head shown in FIG. 6 will have a fixed position and a limited filed of view of the spray head to interrogate as indicated by arrow 60. Arrow 58 shows the field of view detection means may detect to determine whether a refill is loaded in the device by interrogating the area normally occupied by a spray head 22 when a refill is loaded therein. In this arrangement the interrogation, shown by arrows 62,62', emitted from the detection means should be tuned such that it is capable of travelling the distance between the non-cutaway portion of the spray head and back again after reflection, however, should that distance be increased the radiation is less capable of travelling the increased distance. Due to the tuning of the radiation, the amount of radiation being collected by the detection means along arrow 62 would be less than from the radiation travelling along arrow 62', this difference in reflectance being detectable by the detection means, thus indicating two areas of differing reflectance.

All of the features disclosed in this specification (including any accompanying claims, abstract and drawings), and/or all of the steps of any method or process so disclosed, may be combined in any combination, except combinations where at least some of such features and/or steps are mutually exclusive. Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features. The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A spraying system comprising a device with a refill of fluid therein, wherein the refill comprises a body forming a reservoir for the fluid and a spray head located at an uppermost part of the refill in fluid communication with the reservoir, and wherein the device comprises a housing adapted to receive the refill therein and having an aperture suitable for permitting the spraying of the fluid from an exit orifice of the spray head therethrough, the device further comprising actuation means configured for periodic actuation of the refill, wherein the device is provided with detection means that distinguish between at least one area of lower reflectance and at least one area of relatively higher reflectance on the spray head of said refill, and wherein the detection means only operates to distinguish between said areas of differing reflectance during the upward movement of the spray head, said upward movement being provided by the inherent resilience or internal pressure of the refill and without electrical power being applied to the actuation means.

2. A system according to claim 1, wherein the spray head is provided with a single area of lower reflectance and a single area of relatively higher reflectance.

3. A system according to claim 1, wherein the device is provided with an end of life indication in the form of a counting mechanism.

4. A system according to claim 3, wherein the counting mechanism is calibrated to allow a pre-determined number of actuations of the refill which corresponds to the quantity of fluid stored in a refill.

5. A system according to claim 1, wherein the detection means is configured to interrogate the spray head by emitting, radiation toward the spray head and collecting reflected radiation, and said means attributing specifically or approximately or generally the amount of reflected radiation to one or more portions of the spray head.

6. A system according to claim 5 wherein the detection means are configured to make a determination that there are differing levels of reflectance between at least two separate portions of the spray head when collected reflectance from one portion is at least 0.5 times greater than from a separate portion of the spray head.

7. A system according to claim 1, wherein the detection means are provided with a fixed location within the device and have a fixed field of view with respect to the spray head or an area normally occupied by the spray head when a refill is loaded in the device.

8. A system according to claim 1, wherein the detection means are provided in the form of one or more sensors having a radiation emitter and a collecting portion.

9. A system according to claim 1, wherein the detection means is operable to interrogate a spray head which may be up to 100 mm distant from the detection means.

10. A system according to claim 1, wherein the areas of differing reflectance on the spray head are provided by a combination of a substantially white color and a substantially black color.

11. A system according to claim 1, wherein the spray head has a generally L-shaped profile defining a shorter part and a longer part relative to each other, and wherein the shorter part is engaged with a free end of a valve stem of the refill and said shorter part has a single substantially black mark on a rearward portion thereof.

12. A system according to claim 1, wherein the spray head is provided with a portion cutaway to provide a greater distance for reflected interrogation to travel, in use, to a detection means in comparison to the distance for reflected interrogation to travel from a non-cutaway portion of the spray head.

13. A system according to claim 1, wherein the areas of differing reflectance on the spray head are provided by a substantially white spray head which provides a first area of reflectance and, on the spray head a region of substantially black coloration which provides a second area of reflectance.

14. A method of spraying a fluid, the method comprising the steps of:

providing the system according to claim 1;

loading the refill of fluid in the device;

placing the device in an operation mode, said mode being configured to cause activation of the actuation means, said actuation means periodically operating to bear against the spray head of the refill and causing the movement thereof to release a quantity of fluid from the refill, said released fluid being sprayed from the device through an aperture in the housing into the surrounding environment.

* * * * *